US005781884A

United States Patent [19]

Pereira et al.

[11] Patent Number: 5,781,884

[45] Date of Patent: Jul. 14, 1998

[54] GRAPHEME-TO-PHONEME CONVERSION OF DIGIT STRINGS USING WEIGHTED FINITE STATE TRANSDUCERS TO APPLY GRAMMAR TO POWERS OF A NUMBER BASIS

[75] Inventors: Fernando Carlos Neves Pereira, Westfield, N.J.; Michael Dennis Riley, New York, N.Y.; Richard William Sproat, Berkeley Heights, N.J.

[73] Assignee: Lucent Technologies, Inc., Murray Hill, N.J.

[21] Appl. No.: 755,041

[22] Filed: Nov. 22, 1996

Related U.S. Application Data

[63] Continuation of Ser. No. 410,170, Mar. 24, 1995, abandoned.

[51] Int. Cl.[6] ..... G10L 9/18

[52] U.S. Cl. ..... 704/260; 704/9; 704/257; 704/266

[58] Field of Search ..... 395/2.75, 2.67, 395/2.69, 2.78, 2.09, 2.12, 2.13, 2.66, 2.64, 2.7, 2.74, 2.76, 2.77; 704/266, 258, 260, 269, 203, 204, 257, 255, 200, 9

[56] References Cited

U.S. PATENT DOCUMENTS 5,353,336 10/1994 Hou et al. ..... 379/67
5,634,084 5/1997 Malsheen et al. ..... 395/2.69

OTHER PUBLICATIONS

Richard Sproat, "A Finite-State Architecture for Tokenization and Grapheme-to-Phoneme Conversion in Multilingual Text Analysis," Proceedings of the EACL SIGDAT Workshop, Susan Armstrong and Evelyne Tzoukermann, eds., pp. 65–72, Mar. 27, 1995.

Richard Sproat, "Multilingual Text Analysis for Text-to-Speech Synthesis," Proceedings of the ECAI 96 Workshop, 11 Aug. 1996.

Mehryar Mohri, Fernando Pereira, and Michael Riley, "Weighted Automata, in Text and Speech Processing," Proceedings of the ECAI 96 Workshop, 11 Aug. 1996.

N. Yiourgalis and G. Kokkinakis, "Text-to-Speech System for Greek," ICASSP-91 (Toronto), 14–17 Apr. 1991.

Coker, C. et al., "Morphology and rhyming: Two powerful alternatives to letter-to-sound rules for Speech Synthesis," *Proc. of ESCA Workshop on Speech Synthesis*, (G. Bailly and C. Benoit, eds.), pp. 83–86, 1990.

Nunn, A. et al., "MORPHON: Lexicon-based text-to phoneme conversion and phonological rules," *Analysis and Synthesis of Speech: Strategic Research* towards High-Quality Text-to-Speech Generation (V. van Heuven and L. Pols, eds.), pp. 87–99, Berlin: Mouton de Gruyter, 1993.

Lindstrom, A. et al., "Text processing within a speech synthesis systems," *Proc. of the Int. Conf. on Spoken Lang. Proc.*, (Yokohama), ICSLP, Sep. 1994.

DeFrancis, J., *The Chinese Language*, Honolulu; University of Hawaii Press, 1984.

(List continued on next page.)

*Primary Examiner*—David R. Hudspeth
*Assistant Examiner*—Donald L. Storm

[57] ABSTRACT

The present invention provides a method of expanding a string of one or more digits to form a verbal equivalent using weighted finite state transducers. The method provides a grammatical description that expands the string into a numeric concept represented by a sum of powers of a base number system, compiles the grammatical description into a first weighted finite state transducer, provides a language specific grammatical description for verbally expressing the numeric concept, compiles the language specific grammatical description into a second weighted finite state transducer, composes the first and second finite state transducers to form a third weighted finite state transducer from which the verbal equivalent of the string can be synthesized, and synthesizes the verbal equivalent from the third weighted finite state transducer.

1 Claim, 8 Drawing Sheets

OTHER PUBLICATIONS

Pereira, F. et al., "Weighted rational transductions and their application to human language processing," *ARPA Workshop on Human Language Technology*, pp. 249–254, Advanced Research Projects Agency, Mar. 8–11, 1994.

Kaplan, R. et al., "Regular models of phonological rule systems," *Computational Linguistics*, vol. 20, pp. 331–378, 1994.

Sproat, R. et al., "A stochastic finite–state word–segmentation algorithm for Chinese," *Assoc. for Computational Linguistics, Proc. of 32nd Annual Meeting*, pp. 66–73, 1994.

Riley, M., "A statistical model for generating pronunciation networks," *Proc. of Speech and Natural Language Workshop*, p. S11.1., DARPA, Morgan Kaufmann, Oct. 1991.

Mohri, M., "Analyse et representation par automates de structures syntaxiques composees", PhD thesis, Univ. of Paris 7, Paris, 1993.

Church, K., "A stochastic parts program and noun phrase parser for unrestricted text," *Proc of Second Conf. on Appl. Natural Language Proc.*, (Morristown, NJ), pp. 136–143, Assoc. for Computational Linguistics, 1988.

FIG. 5

- UNIFORM FINITE-STATE MODEL MAKES IT STRAIGHTFORWARD TO INCORPORATE MORPHOLOGY, AS WELL AS MODELS FOR NAMES AND TRANSLITERATIONS.
- EASILY ADAPTED TO SITUATIONS WHERE INPUT IS A LATTICE RATHER THAN A SINGLE PATH:

| SIMPLIFIED | TRADITIONAL | |
|---|---|---|
| 里 | 里 *li3* 'mile' | 裡 *li3* 'in' |
| 面 | 面 *mian4* 'side' | 麵 *mian4* dough |

里面 ⇨ 里 面 / 裡 麵

- EASY TO INTERFACE TO FINITE-STATE MODELS OF SPEECH RECOGNITION (PEREIRA et al. 1994)

GRAPHEME-TO-PHONEME CONVERSION OF DIGIT STRINGS USING WEIGHTED FINITE STATE TRANSDUCERS TO APPLY GRAMMAR TO POWERS OF A NUMBER BASIS

This is a Continuation of application Ser. No. 08/410,170 filed Mar. 24, 1995, now abandoned.

1 FIELD OF THE INVENTION

The present invention relates to the field of text analysis systems for text-to-speech synthesis systems.

2 BACKGROUND OF THE INVENTION

One domain in which text-analysis plays an important role is in text-to-speech (TTS) synthesis. One of the first problems that a TTS system faces is the tokenization of the input text into words, and the subsequent analysis of those words by part-of-speech assignment algorithms, graphemeto-phoneme conversion algorithms, and so on. Designing a tokenization and text-analysis system becomes particularly tricky when wishes to build multilingual systems that are capable of handling a wide range of languages including Chinese or Japanese, which do not mark word boundaries in text, and European languages which typically do. This paper describes an architecture for text-analysis that can be configured for a wide range of languages. Note that since TTS systems are being used more and more to generate pronunciations for automatic speech-recognition (ASR) systems, text-analysis modules of the kind described here have a much wider applicability than just TTS.

Every TTS system must be able to convert graphemic strings into phonological representations for the purpose of pronouncing the input. Extant systems for grapheme-to-phoneme conversion range from relatively ad hoc implementations where many of the rules are hardwired, to more principled approaches incorporating (putatively general) morphological analyzers, and phonological rule compilers; yet all approaches have their problems.

Systems where much of the linguistic information is hardwired are obviously hard to port to new languages. More general approaches have favored doing a more-or-less complete morphological analysis, and then generating the surface phonological form from the underlying phonological representations of the morphemes. But depending upon the linguistic assumptions embodied in such a system, this approach is only somewhat appropriate. To take a specific example, the underlying morphophonological form of the Russian word костра/kastɾa/(bonfire+genitive, singular) would arguably be кост{Ё}ра, where {Ё} is an archiphoneme that deletes in this instance (because of the -а in the genitive marker), but surfaces as ё in other instances (e.g., the nominative singular form костёр/kastɾjor/). Since these alternations are governed by general phonological rules, it would certainly be possible to analyze the surface string into its component morphemes, and then generate the correct pronunciation from the phonological representation of those morphemes. However, this approach involves some redundancy given that the vowel deletion in question is already represented in the orthography: the approach just described in effect reconstitutes the underlying form, only to have to recompute what is already known. On the other hand, we cannot dispense with morphological information entirely since the pronunciation of several Russian vowels depends upon stress placement, which in turn depends upon the morphological analysis: in this instance, the pronunciation of the first <о> is /a/ because stress is on the ending.

Two further shortcomings can be identified in current approaches. First of all, grapheme-to-phoneme conversion is typically viewed as the problem of converting ordinary words into phoneme strings, yet typical written text presents other kinds of input, including numerals and abbreviations. As we have noted, for some languages, like Chinese, word-boundary information is missing from the text, and must be 'reconstructed' using a tokenizer. In all TTS systems of which we are aware, these latter issues are treated as problems in text preprocessing. So, special-purpose rules would convert numeral strings into words, or insert spaces between words in Chinese text. These other problems are not thought of as merely specific instances of the more general grapheme-to-phoneme problem.

Secondly, text-to-speech systems typically deterministically produce a single pronunciation for a word in a given context: for example, a system may choose to pronounce data as/dæt ə/ (rather than/de ɪt ə/) and will consistently do so. While this approach is satisfactory for a pure TTS application, it is not ideal for situations—such as ASR (see the final section of this paper)—where one wants to know what possible variant pronunciations are and, equally importantly, their relative likelihoods. Clearly what is desirable is to provide a grapheme-to-phoneme module in which it is possible to encode multiple analyses, with associated weights or probabilities.

3 SUMMARY OF THE INVENTION.

The present invention provides a method of expanding one or more digits to form a verbal equivalent. In accordance with the invention, a linguistic description of a grammar of numerals is provided. This description is compiled into one or more weighted finite state transducers. The verbal equivalent of the sequence of one or more digits is synthesized with use of the one or more weighted finite state transducers.

4 DESCRIPTION OF DRAWINGS.

FIG. 1 presents the architecture of the proposed grapheme-to-phoneme system, illustrating the various levels of representation of the Russian word костра/kastɾa/ (bonfire+genitive.singular). The detailed description is given in Section 5.

FIG. 5 is a diagram illustrating a uniform finite-state model.

5 DETAILED DESCRIPTION

5.1 An Illustration of Grapheme-to-Phoneme Conversion

Figure 1:
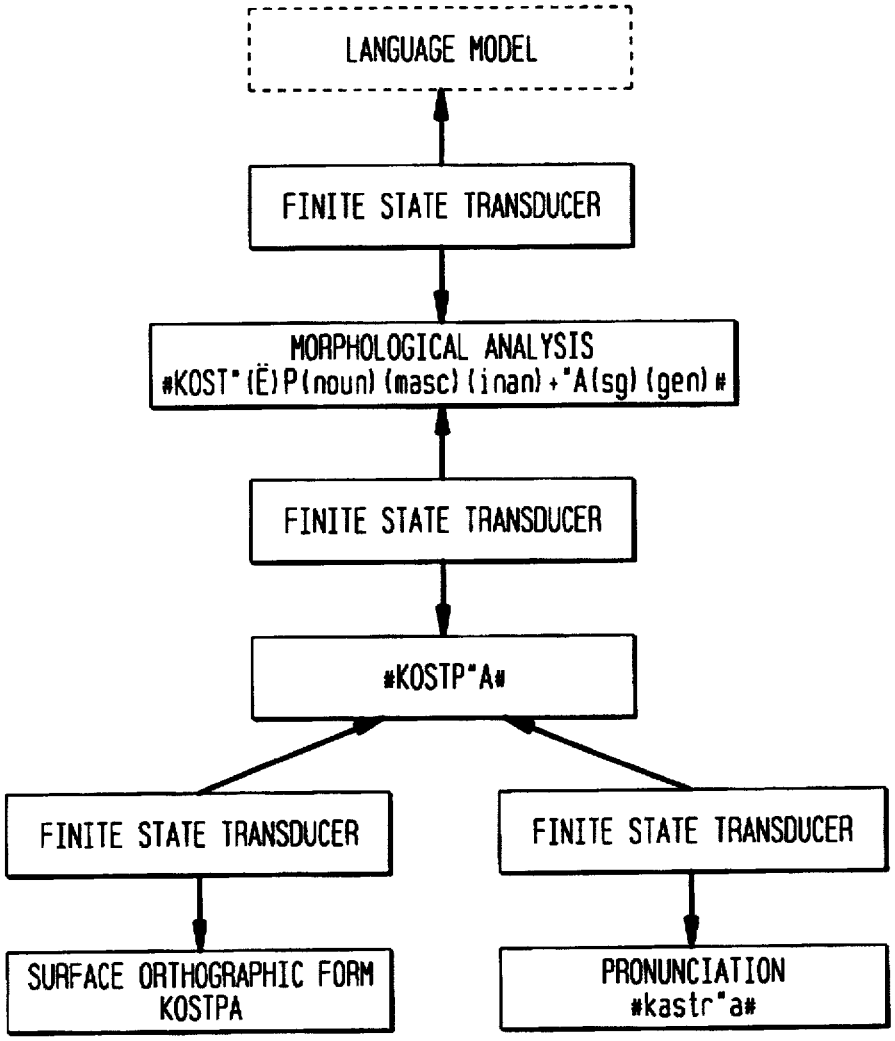

All language writing systems are basically phonemic—even Chinese. In addition to the written symbols, different languages require more or less lexical information in order to produce an appropriate phonological representation of the input string. Obviously the amount of lexical information required has a direct inverse relationship with the degree to which the orthographic system is regarded as 'phonetic', and it is worth pointing out that there are probably no languages which have completely 'phonetic' writing systems in this sense. The above premise suggests that mediating between orthography, phonology and morphology we need a fourth level of representation, which we will dub the minimal morphological annotation or MMA, which contains just enough lexical information to allow for the correct pronunciation, but (in general) falls short of a full morphological analysis of the form. These levels are related, as diagrammed in FIG. 1, by transducers, more specifically Finite State Transducers (FSTs), and more generally Weighted FSTs (WFSTs), which implement the linguistic rules relating the levels. In the present system, the (W)FSTs are derived from a linguistic description using a lexical toolkit incorporating (among other things) the Kaplan-Kay rule compilation algorithm, augmented to allow for weighted rules. The system works by first composing the surface form, represented as an unweighted Finite State Acceptor (FSA), with the Surface-to-MMA (W)FST, and then projecting the output to produce an FSA representing the lattice of possible MMAs; second the MMA FSA is composed with the Morphology-to-MMA map, which has the combined effect of producing all and only the possible (deep) morphological analyses of the input form, and restricting the MMA FSA to all and only the MMA forms that can correspond to the morphological analyses. In future versions of the system, the morphological analyses will be further restricted using language models (see below). Finally, the MMA-to-Phoneme FST is composed with the MMA to produce a set of possible phonological renditions of the input form.

As an illustration, let us return to the Russian example костра(bonfire+genitive.singular), given in the background. As noted above, a crucial piece of information necessary for the pronunciation of any Russian word is the placement of lexical stress, which is not in general predictable from the surface form, but which depends upon knowledge of the morphology. A few morphosyntactic features are also necessary: for instance the <г>, which is generally pronounced/g/or/k/depending upon its phonetic context, is regularly pronounced/v/in the adjectival masculine/neuter genitive ending -(о/е)го: therefore for adjectives at least the feature +gen must be present in the MMA. Returning to our particular example, we would like to augment the surface spelling of костра with some information that stress is on the second syllable—hence костра. This is accomplished as follows: the FST that maps from the MMA to the surface orthographic representation allows for the deletion of stress anywhere in the word (given that, outside pedagogical texts, stress is never represented in the surface orthography of Russian); consequently, the inverse of that relation allows for the insertion of stress anywhere. This will give us a lattice of analyses with stress marks in any possible position, only one of these analyses being correct. Part of knowing Russian morphology involves knowing that костёр 'bonfire' is a noun belonging to a declension where stress is placed on the ending, if there is one—and otherwise reverts to the stem, in this case the last syllable of the stem. The underlying form of the word is thus represented roughly as кост{Ё}р{noun}{masc}{inan}+а{sg}{gen} (inan= 'inanimate'), which can be related to the MMA by a number of rules. First, the archiphoneme {Ё} surfaces as ё or Ø depending upon the context; second, following the Basic Accentuation Principle of Russian, all but the final primary stress of the word is deleted. Finally, most grammatical features are deleted, except those that are relevant for pronunciation. These rules (among others) are compiled into a single (W)FST that implements the relation between the underlying morphological representation and the MMA. In this case, the only licit MMA form for the given underlying form is КосТра. Thus, assuming that there are no other lexical forms that could generate the given surface string, the composition of the MMA lattice and the Morphology-to-MMA map will produce the unique lexical form кост{Ё}р{noun}{masc}{inan}+а{sg}{gen} and the unique MMA form костра. A set of MMA-to-Phoneme rules, implemented as an FST, is then composed with this to produce the phonemic representation/kastra/. These rules include pronunciation rules for vowels: for example, the vowel <о> is pronounced/a/when it occurs before the main stress of the word.

5.2 Tokenization of Text into Words

In the previous discussion we assumed implicitly that the input to the grapheme-to-phoneme system had already been segmented into words, but in fact there is no reason for this assumption: we could just as easily assume that an input sentence is represented by the regular expression:

(1) Sentence:= (word ⌢ (whitespace ∨punct))+

Thus one could represent an input sentence as a single FSA and intersect the input with the transitive closure of the dictionary, yielding a lattice containing all possible morphological analyses of all words of the input. This is desirable for two reasons.

First, for the purposes of constraining lexical analyses further with (finite-state) language models, one would like to be able to intersect the lattice derived from purely lexical constraints with a (finite-state) language-model implementing sentence-level constraints, and this is only possible if all possible lexical analyses of all words in the sentence are present in a single representation.

Secondly, for some languages, such as Chinese, tokenization into words cannot be done on the basis of whitespace, so the expression in (1) above reduces to:

(2) Sentence:=(word ⌢ (opt: punctuation))+

Following the work reported in [7], we can characterize the Chinese grapheme-to-phoneme problem as involving tokenizing the input into words, then transducing the tokenized words into appropriate phonological representations. As an illustration, consider the input sentence 我忘不了你/wo3 wang4-bu4-liao3 ni3/(I forget+Negative.Potential you.sg.) 'I cannot forget you'. The lexicon of (Mandarin) Chinese contains the information that 我 'I' and 你 'you.sg.' are pronouns, 忘 'forget' is a verb, and 不了 (Negative.Potential) is an affix that can attach to certain verbs. Among the features important for Mandarin pronunciation are the location of word boundaries, and certain grammatical features: in this case, the fact that the sequence 不了 is functioning as a potential affix is important since it means that the character 了, normally pronounced/le0/, is here pronounced /liao3/. In general there are several possible segmentations of any given sentence, but following the approach described in, we can usually select the best segmentation by picking the sequence of most likely unigrams—i.e., the best path through the WFST representing the morphological analysis of the input. The underlying representation and the MMA are thus, respectively, as follows (where '#' denotes a word boundary):

(3) #我{pron}#忘{verb}+不{neg}了{potential}#
#你{pron}#

(4) #我#忘+不了POT#你#

The pronunciation can then be generated from the MMA by a set of phonological interpretation rules that have some mild sensitivity to grammatical information, as was the case in the Russian examples described.

On the face of it, the problem of tokenizing and pronouncing Chinese text would appear to be rather different from the problem of pronouncing words in a language like Russian. The current model renders them as slight variants on the same theme, a desirable conclusion if one is interested in designing multilingual systems that share a common architecture.

5.3 Expansion of Numerals

One important class of expressions found in naturally occurring text are numerals. Sidestepping for now the question of how one disambiguates numeral sequences (in particular cases, they might represent, inter alia, dates or telephone numbers), let us concentrate on the question of how one might transduce from a sequence of digits into an appropriate (set of) pronunciations for the number represented by that sequence. Since most modern writing systems at least allow some variant of the Arabic number system, we will concentrate on dealing with that representation of numbers. The first point that can be observed is that no matter how numbers are actually pronounced in a language, an Arabic numeral representation of a number, say 3005 always represents the same numerical 'concept'. To facilitate the problem of converting numerals into words, and (ultimately) into pronunciations for those words, it is helpful to break down the problem into the universal problem of mapping from a string of digits to numerical concepts, and the language-specific problem of articulating those numerical concepts.

The first problem is addressed by designing an FST that transduces from a normal numeric representation into a sum of powers of ten. Obviously this cannot in general be expressed as a finite relation since powers of ten do not constitute a finite vocabulary. However, for practical purposes, since no language has more than a small number of 'number names' and since in any event there is a practical limit to how long a stream of digits one would actually want read as a number, one can handle the problem using finite-state models. Thus 3,005 could be represented in 'expanded' form as {3}{1000}{0}{100}{0}{10}{5}.

Language-specific lexical information is implemented as follows, taking Chinese as an example. The Chinese dictionary contains entries such as the following:

| | | |
|---|---|---|
| {3}三 | san1 | 'three' |
| {5}五 | wu3 | 'five' |
| {1000}千 | qian1 | 'thousand' |
| {100}百 | bai3 | 'hundred' |
| {10}十 | shi2 | 'ten' |
| {0}零 | ling2 | 'zero' |

We form the transitive closure of the entries in the dictionary (thus allowing any number name to follow any other), and compose this with an FST that deletes all Chinese characters. The resulting FST—call it $T_1$—when intersected with the expanded form {3}{1000}{0}{100}{0}{10}{5} will map it to {3}三{1000}千{0}零{100}百{0}零{10}十{5}五. Further rules can be written which delete the numerical elements in the expanded representation, delete symbols like 百 'hundred' and 十 'ten' after 零 'zero', and delete all but one 零 'zero' in a sequence; these rules can then be compiled into FSTs, and composed with $T_1$ to form a Surface-to-MMA mapping FST, that will map 3005 to the MMA 三千零五 (san1 qian1 ling2 wu3).

A digit-sequence transducer for Russian would work similarly to the Chinese case except that in this case instead of a single rendition, multiple renditions marked for different cases and genders would be produced, which would depend upon syntactic context for disambiguation.

Figure 2:
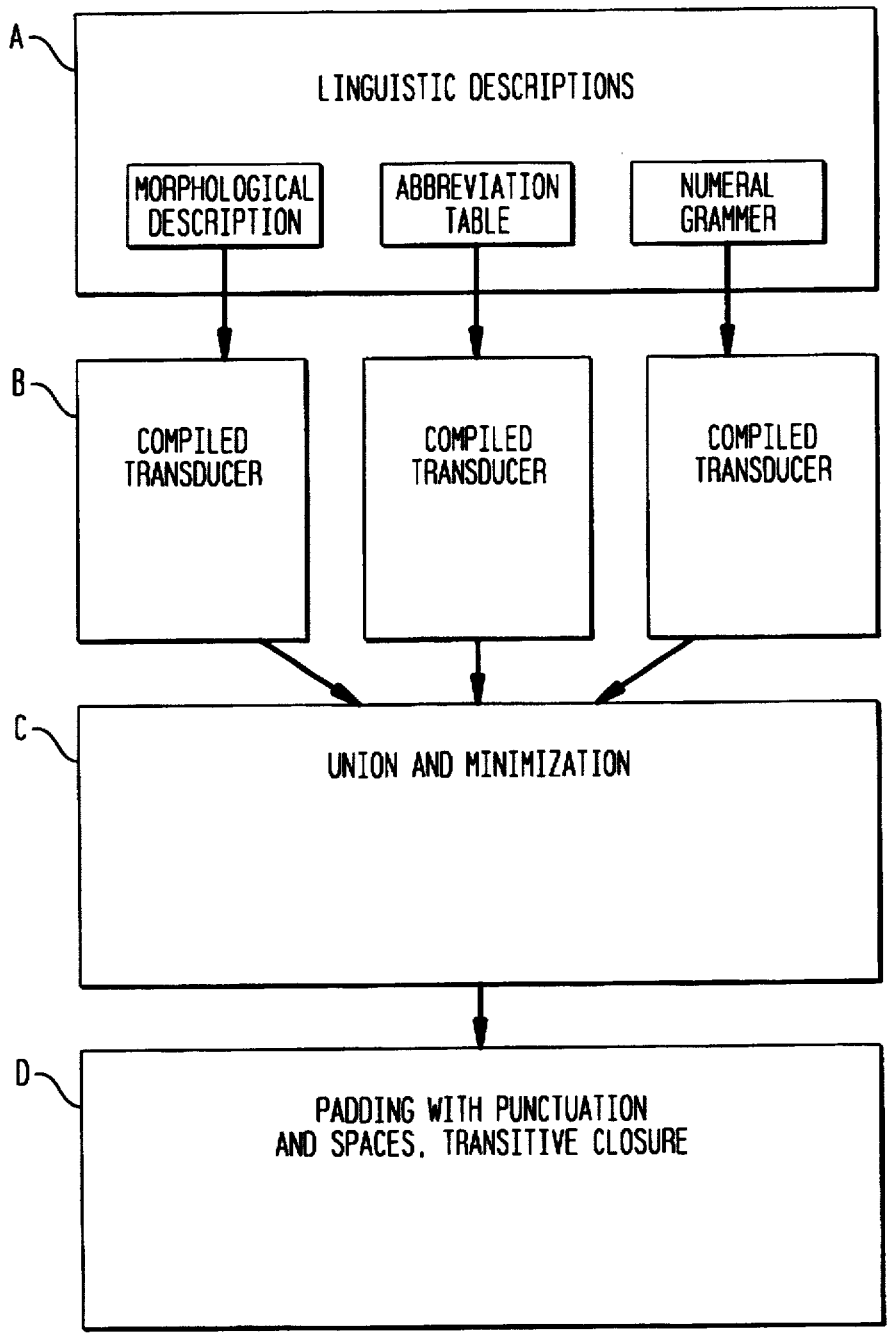
FIG. 2 illustrates the process for constructing an FST that relating two levels of representation in FIG. 1.
Figure 3:
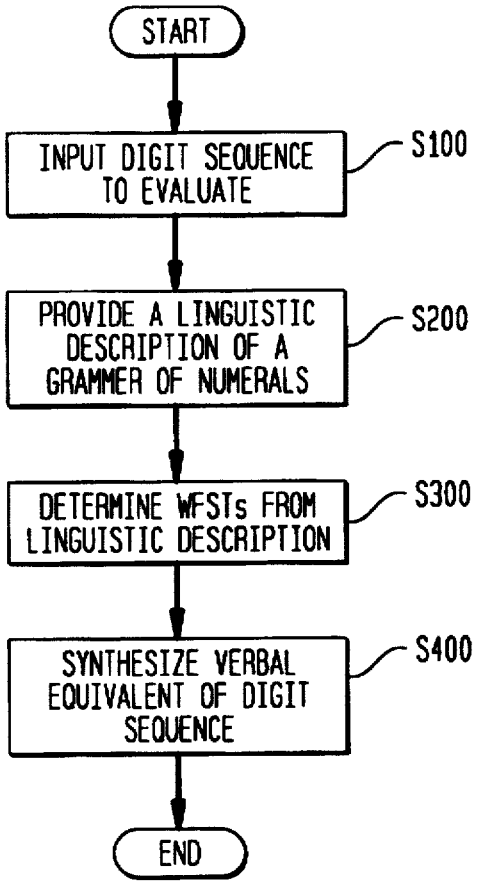
FIG. 3 illustrates a flow chart for determining a verbal equivalent of digits in text.
Figure 4:
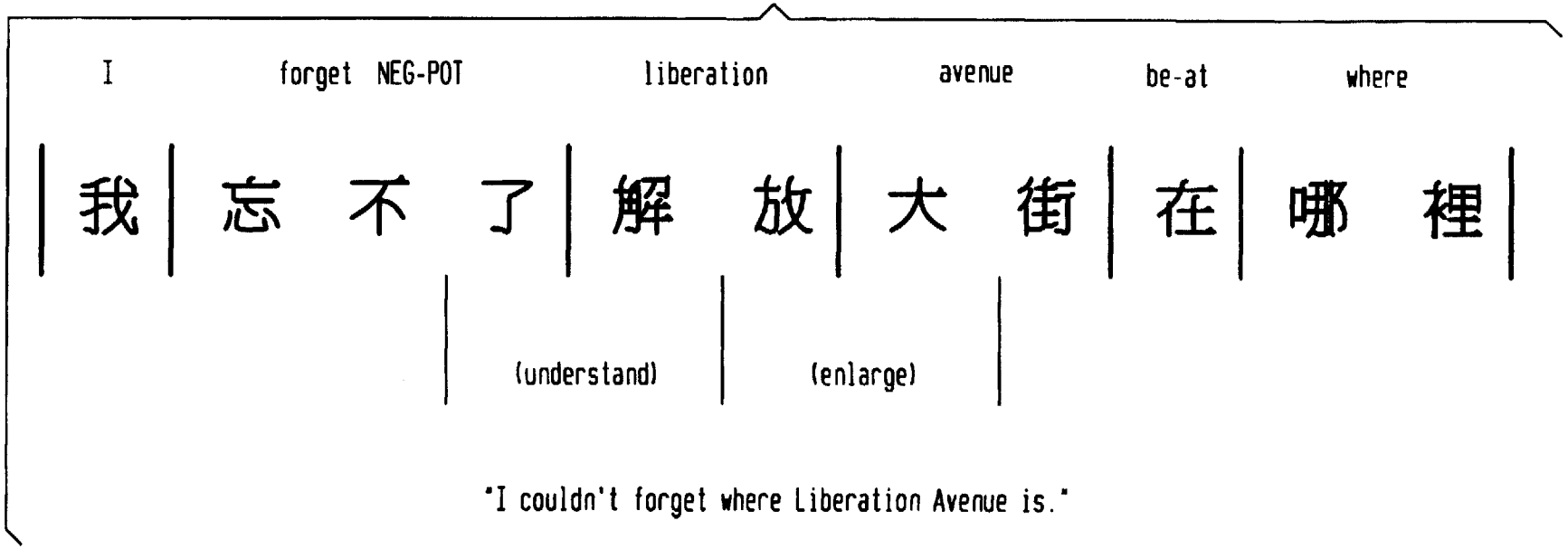
FIG. 4 illustrates an example of Chinese tokenization.
Figure 6:
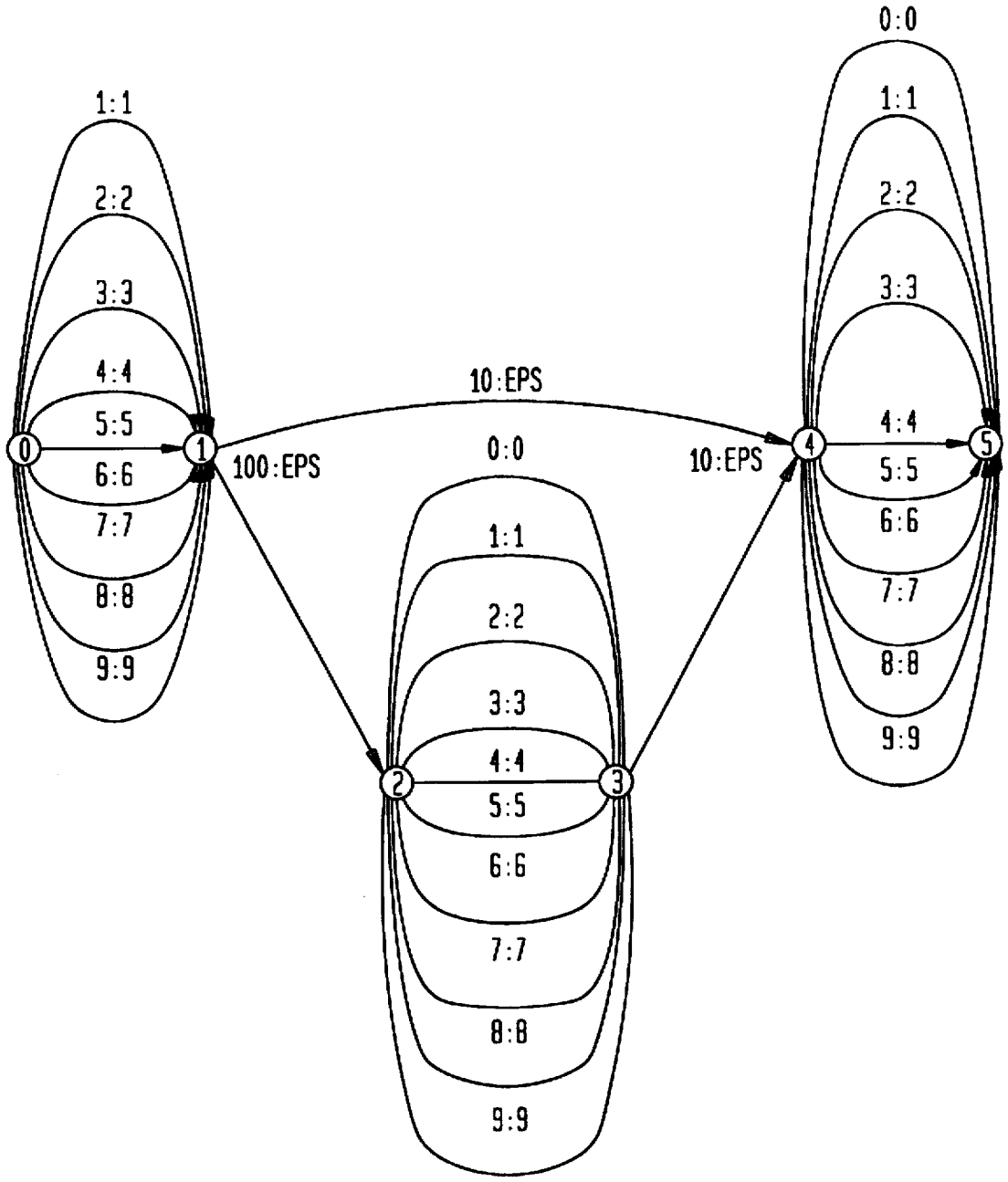
FIG. 6 is a diagram illustrating a universal meaning-to-digit-string transducer.
Figure 7:
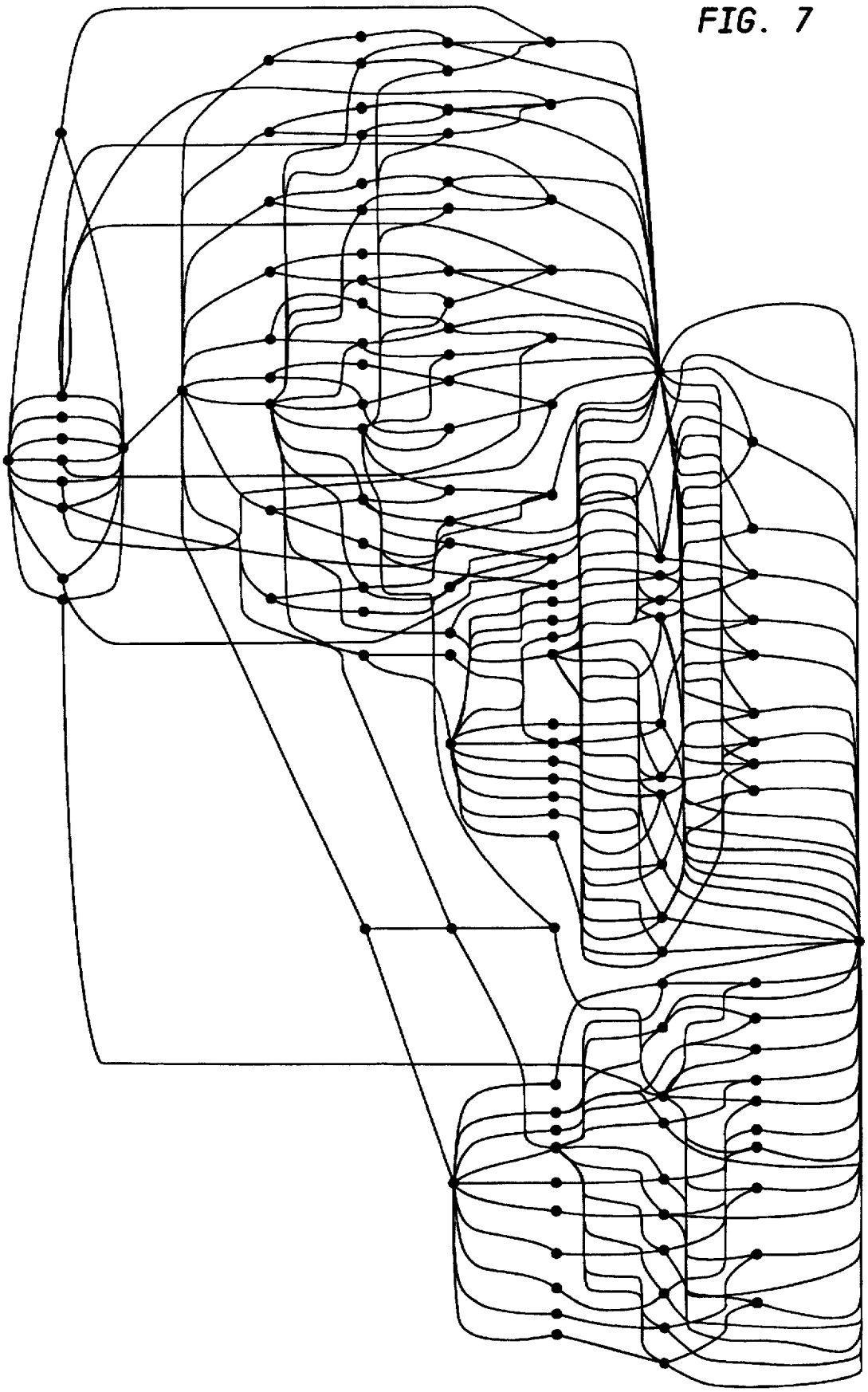
FIG. 7 is a diagram illustrating an English-particular word-to-meaning transducer.
Figure 8:
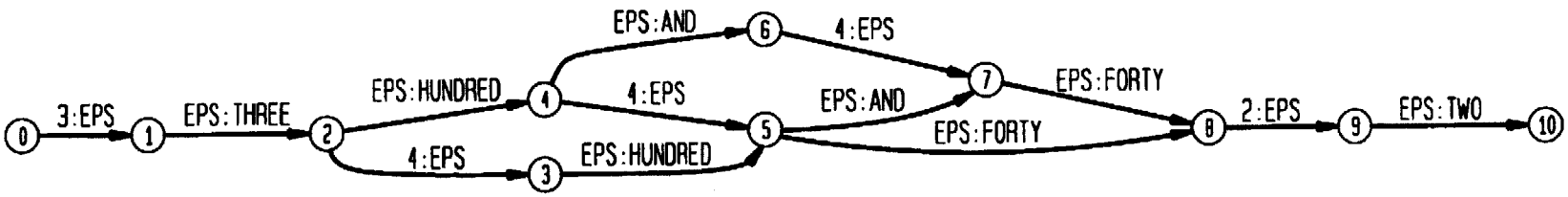
FIG. 8 is a diagram illustrating transductions of 342 in English.
Figure 9:
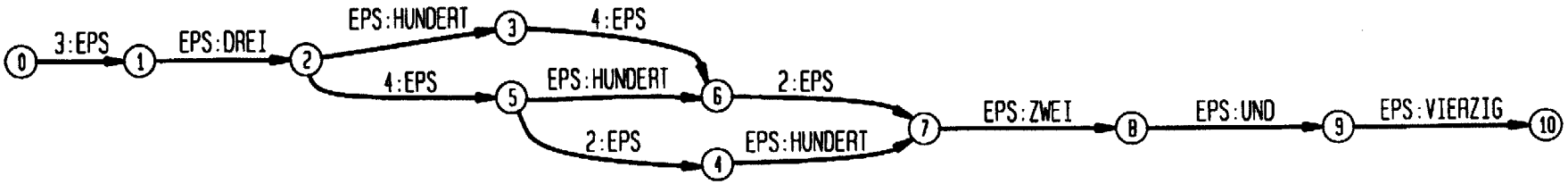
FIG. 9 is a diagram illustrating transductions of 342 in German.

FIG. 2 illustrates the process of constructing a weighted finite-state transducer relating two levels of representation in FIG. 1 from a linguistic description. As illustrated in the section of the Figure labeled 'A', we start with linguistic descriptions of various text-analysis problems. These linguistic descriptions may include weights that encode the relative likelihoods of different analyses in case of ambiguity. For example, we would provide a morphological description for ordinary words, a list of abbreviations and their possible expansions and a grammar for numerals. These descriptions would be compiled into FSTs using a lexical toolkit—'B' in the Figure. The individual FSTs would then be combined using a union (or summation) operation—'C' in the Figure, and can be also be made compact using minimization operations. This will result in an FST that can analyze any single word. To construct an FST that can analyze an entire sentence we need to pad the FSTs constructed thus far with possible punctuation marks (which may delimit words) and with spaces, for languages which use spaces to delimit words—see 'D', and compute the transitive closure of the machine. FIGS. 3–9 illustrate embodiments of the invention.

We have described a multilingual text-analysis system, whose functions include tokenizing and pronouncing orthographic strings as they occur in text. Since the basic workhorse of the system is the Weighted Finite State Transducer, incorporation of further useful information beyond what has been discussed here may be performed without deviating from the spirit and scope of the invention.

For example, TTS systems are being used more and more to generate pronunciations for automatic speech-recognition (ASR) systems. Use of WFSTs allows one to encode probabilistic pronunciation rules, something useful for an ASR application. If we want to represent data as being pronounced/deɪtə/ 90% of the time and as/dætə 10% of the time, then we can include pronunciation entries for the string data listing both pronunciations with associated weights (—$\log_2$(prob)):

(6) data deɪtə<0.15>data dætə<3.32>

The use of finite-state models of morphology also makes for easy interfacing between morphological information and finite state models of syntax. One obvious finite-state syntactic model is an n-gram model of part-of-speech sequences. Given that one has a lattice of all possible morphological analyses of all words in the sentence, and assuming one has an n-gram part of speech model implemented as a WFSA, then one can estimate the most likely sequence of analyses by intersecting the language model with the morphological lattice.

What is claimed is:

1. A method of expanding a string of one or more digits to form a verbal equivalent, the method comprising the steps of:

(a) providing a grammatical description that expands the string into a numeric concept represented by a sum of powers of a base number system;

(b) compiling said grammatical description into a first weighted finite state transducer (WFST);

(c) providing a language specific grammatical description for verbally expressing the numeric concept;

(d) compiling the language specific grammatical description into a second WFST;

(e) composing said first and second WFSTs to form a third WFST from which the verbal equivalent of the string can be synthesized; and (f) synthesizing the verbal equivalent from the third WFST.

* * * * *